US008434545B2

(12) United States Patent
Huber et al.

(10) Patent No.: US 8,434,545 B2
(45) Date of Patent: May 7, 2013

(54) DIE CASTING TOOL OF A DIE CASTING MACHINE

(75) Inventors: Ignaz Huber, Train-St. Johann (DE); Thomas Pippel, Unterhaching (DE)

(73) Assignee: Georg Fischer Dienstleistungen GmbH, Mettmann (DE)

( * ) Notice: Subject to any disclaimer, the term of this patent is extended or adjusted under 35 U.S.C. 154(b) by 117 days.

(21) Appl. No.: 12/921,727

(22) PCT Filed: Mar. 10, 2009

(86) PCT No.: PCT/EP2009/001686

§ 371 (c)(1),
(2), (4) Date: Oct. 18, 2010

(87) PCT Pub. No.: WO2009/112230

PCT Pub. Date: Sep. 17, 2009

(65) Prior Publication Data

US 2011/0030913 A1 Feb. 10, 2011

(30) Foreign Application Priority Data

Mar. 11, 2008 (EP) ..... 08102489

(51) Int. Cl.

| | |
|---|---|
| ***B22D 17/20*** | (2006.01) |
| ***B22D 17/22*** | (2006.01) |
| ***B22D 31/00*** | (2006.01) |
| ***B22D 33/04*** | (2006.01) |

(52) U.S. Cl.

USPC ..... 164/262; 164/341; 164/342; 164/344

(58) Field of Classification Search ..... 164/339, 164/341, 342, 344, 137, 262

See application file for complete search history.

(56) References Cited

U.S. PATENT DOCUMENTS

| | | | | |
|---|---|---|---|---|
| 1,717,254 | A | 6/1929 | Polak | |
| 3,791,440 | A * | 2/1974 | Cross | 164/113 |
| 5,887,643 | A * | 3/1999 | Nakamura et al. | 164/340 |
| 6,171,094 | B1 | 1/2001 | Von Holdt | |
| 6,336,494 | B1 * | 1/2002 | Dobusch | 164/129 |

FOREIGN PATENT DOCUMENTS

| | | | |
|---|---|---|---|
| DE | 4438969 | | 5/1995 |
| DE | 10225165 | | 12/2003 |
| GB | 1569382 | | 6/1980 |
| JP | 2-303673 | A * | 12/1990 |
| JP | 4-81256 | A * | 3/1992 |
| WO | 00/06322 | | 2/2000 |

* cited by examiner

*Primary Examiner* — Kevin P Kerns

(74) *Attorney, Agent, or Firm* — Bachman & LaPointe, P.C.

(57) ABSTRACT

A die casting tool (1) of a die casting machine, includes a first mold (2) having a first and a second mold part (5, 6), which can be displaced in a linear manner to each other for closing and opening the mold and which form at least one casting chamber between each other, and including at least one casting runner (16), further includes an additional, second mold (3) having a third and a fourth mold part (7, 8), which can be displaced in a linear manner to each other in a parallel manner to the mold parts (5, 6) of the first mold (2) for closing and opening the mold, and which form at least one further casting chamber between each other, wherein a mold part (5, 6) of the first mold (2) and a mold part (7, 8) of the second mold (3) are disposed back-to-back and receive between each other an intermediate element (4), which is the casting runner (16).

6 Claims, 8 Drawing Sheets

DIE CASTING TOOL OF A DIE CASTING MACHINE

BACKGROUND OF THE INVENTION

The invention relates to a die casting tool of a die casting machine, comprising a first mold having a first and a second mold part, which can be shifted linearly in relation to each other for the purpose of mold closing and mold opening and which, between them, constitute at least one mold cavity, and comprising at least one casting runner. Die casting tools of the type mentioned at the outset are known in the art. They are used in a die casting machine. For the purpose of filling the mold cavity (infeeding a shot), a hot, liquid medium, for example a metal, metal alloy or plastic, is applied via the casting runner. The mold, consisting of a first and a second mold part, must be closed beforehand. Once the medium in the casting chamber and in the mold cavity has solidified, the two mold parts are moved apart from each other. Because of this procedural method, the number of workpieces that can be produced per unit of time is limited. In order to increase the number of workpieces, a plurality of casting recesses can be provided in the two mold parts, so as to realize a plurality of mold cavities. The area available for this purpose is limited, however, owing to the materials to be handled, the mold closing pressure to be applied, and so forth.

The invention is therefore based on the object of creating a die casting tool of a die casting machine that has a very high production capacity, i.e. that can produce a multiplicity of cast workpieces per unit of time.

SUMMARY OF THE INVENTION

The foregoing object is achieved, according to the invention, by at least one further, second mold having a third and a fourth mold part, which can be shifted linearly in relation to each other, acting in the same direction as the mold parts of the first mold, for the purpose of mold closing and mold opening and which, between them, constitute at least one further mold cavity, a mold part of the first mold and a mold part of the second mold being arranged back-to-back in relation to each other and accommodating between each other an intermediate element that comprises the casting runner. This design results in a quasi-staged die casting tool, i.e. the at least two molds are disposed in a staged manner in relation to each other, in this case meaning that the molds are arranged above each other or next to each other. Consequently, a plurality of molds are employed simultaneously by one and the same die casting machine, such that a corresponding increase in productivity is obtained. The invention is not limited to two molds but, rather, more than two molds can also be used in a staged structural arrangement above each other and/or next to each other. The arrangement in this case is such that, for the purpose of opening the respective mold, at least one of the associated mold parts is shifted linearly. This linear motion is effected transversely, in particular at right angles, to a mold parting plane. Thus, the individual stages of the die casting tool, comprising a plurality of molds, are shifted linearly in the stated manner for the purpose of mold opening, and shifted linearly in the opposite direction for the purpose of mold closing. The shifting and the shifting motion are always effected—as already mentioned—transversely, in particular at right angles to the individual mold parting planes of the molds, the mold parting planes being located between the two mold parts of the respective mold. To enable the die casting tool according to the invention to be filled with a medium, for example with a liquid metal alloy, an intermediate element, which comprises the casting runner, is arranged between the at least two molds. The at least two mold cavities of the at least two molds are filled via the casting runner. In order to demold the workpieces produced, the molds are opened by being moved apart linearly, after the medium has set. Owing to the mentioned staged structural design of the die casting tool according to the invention, only a very small amount of space is also required for an operation, since the two molds require only one driving and support device for the die casting machine. In the prior art, the operation of two molds requires the use of two die casting machines, which consequently occupy a significantly greater amount of space.

According to a development of the invention, it is provided that the casting runner leads to both mold cavities. Thus, filling of both mold cavities can be effected via one casting runner. Clearly, the invention is not limited to two mold cavities but, rather, each of the at least two molds can comprise a plurality of mold cavities.

Preferably, it is provided that a shearing device, for shearing off at least one sprue, preferably a sprue relating to both molds, is assigned to the intermediate element. The shearing device is located in the region of the intermediate element, i.e. in the zone between the at least two molds. It shears off the sprue realized in the casting runner. It is particularly effective if one shearing device shears off the sprue of both molds, the molds preferably having a common sprue, which is cut off by the shearing device.

The shearing device preferably has a shearing blade that can be shifted linearly, the shift direction of the shearing blade running transversely, in particular at right angles, in relation to the linear shift directions of the mold parts. This configuration makes optimal use of the structural space of the arrangement as a whole, the motion clearances for the mold parts and for the shearing blade being at an angle, in particular at right angles, in relation to each other.

According to a preferred embodiment of the invention, it is provided that the intermediate element has at least two ejector devices for the two molds. Consequently, the ejection means are also accommodated in the intermediate element, for the purpose of emptying the at least two molds. The ejector devices are consequently located, in a space-optimized manner, between the two molds.

The ejector devices have ejection cylinders, in particular block cylinders, which are arranged at the side of the mold parts, which adjoin the intermediate element. Laterally next to the mold parts assigned to the intermediate element, therefore, the space is utilized for positioning the ejection cylinders of the ejector devices. Here, the ejection cylinders are not visually obtrusive, and they make use of an otherwise unused structural space.

The intermediate element preferably has two intermediate-element parts, which are arranged back-to-back in relation to each other. Each intermediate-element part is assigned to one of the two molds.

A development of the invention provides that the first mold part of the first mold is a fixed mold part, in relation to which—for the purpose of closing and opening the first mold—a unit, consisting of the second mold part of the first mold, the intermediate element and the third mold part of the second mold, can be shifted linearly, and—for the purpose of closing and opening the second mold—the fourth mold part can be shifted linearly in relation to the unit. For the purpose of mold opening and mold closing, the first mold part of the first mold maintains its position, and is therefore a fixed mold part. If the molds are to be opened, the unit that consists of the second mold part of the first mold, the intermediate element and the third mold part of the second mold is shifted linearly.

At the same time, beforehand or afterwards, the fourth mold part shifts along a linear path, for the purpose of opening the second mold. If more than two molds are arranged in a staged manner, the preceding statements apply accordingly.

In particular, the first mold part has a fixed, exchangeable mold insert, and the second, the third and the fourth mold part have traveling, exchangeable mold inserts. All mold inserts are exchangeable, to enable differing workpieces to be produced, but the first mold part has a fixed mold insert, because the latter does not change its position during operation of the die casting tool. The word "fixed" therefore relates to the stationary positioning. The other mold parts have traveling mold inserts, because the mold parts, and therefore also the mold inserts assigned to them, thus change their position during opening and closing of the respective mold.

Finally, it is advantageous if a stationary fixing platen, and a movable fixing platen that can be shifted linearly in relation thereto via guide posts, are provided, at least the two molds and at least the one intermediate element being arranged between the two fixing platens. The two fixing platens hold the stage packet, consisting of the mold parts and the intermediate element, together in the closed position of the molds, and they move apart in order to open the molds. If there are more than two molds, more than one intermediate element is also required, since there is one intermediate element between each two molds.

BRIEF DESCRIPTION OF THE DRAWINGS

The drawings illustrate the invention of an exemplary embodiment, wherein.

DETAILED DESCRIPTION

Figure 1:
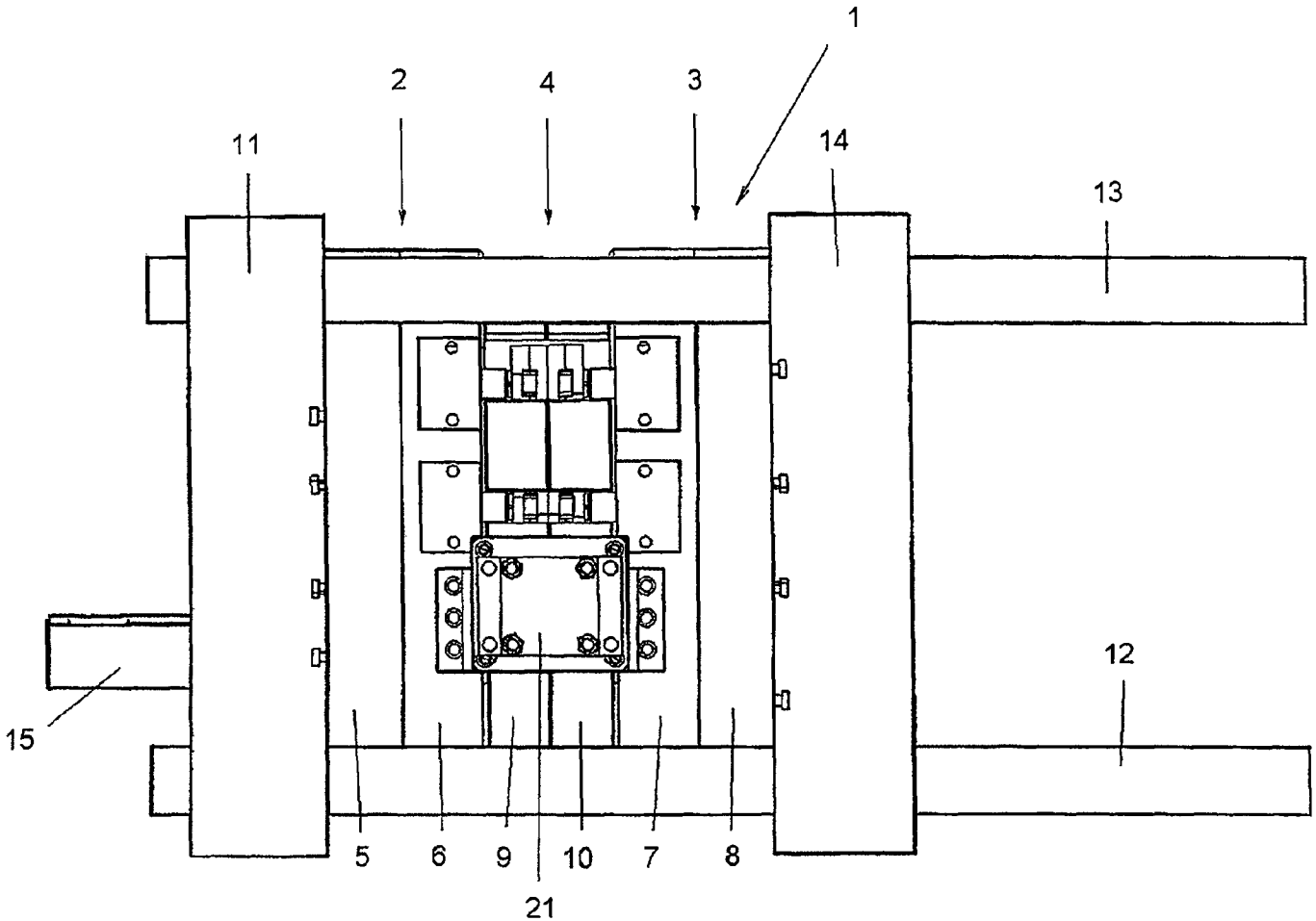
FIG. 1 shows a side view of a die casting tool of a die casting machine in the closed position.
Figure 2:
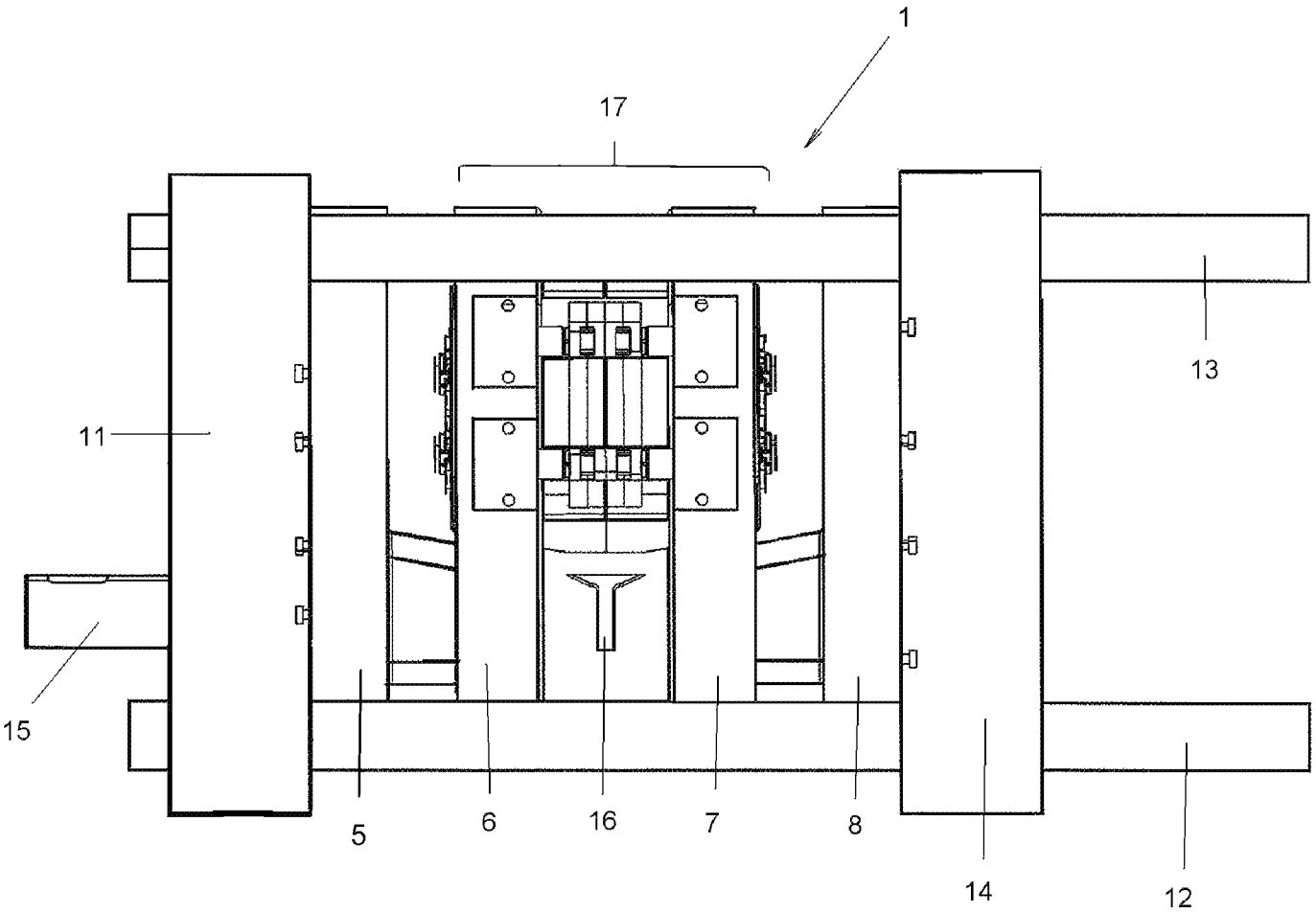
FIG. 2 shows the representation of FIG. 1 in a partially opened position.

FIG. 1 shows a die casting tool 1 in a die casting machine, which is not shown in greater detail, the die casting tool having a first mold 2, a second mold 3 and an intermediate element 4, which is arranged between the two molds 2 and 3. The first mold 2 has a first mold part 5 and a second mold part 6. The second mold has a third mold part 7 and a fourth mold part 8. The intermediate element 4 is composed of two intermediate-element parts 9 and 10. The mold parts 5 and 8 and intermediate-element parts 9 and 10, each of which are realized in plate form, bear—standing on edge—flatly on each other, the first mold part 5 bearing on the second mold part 6, the second mold part 6 bearing on the intermediate-element part 9, the intermediate-element part 9 bearing on the intermediate-element part 10, the intermediate-element part 10 bearing on the third mold part 7, and the third mold part 7 bearing on the fourth mold part 8. A parting plane is realized in each case between the respectively aforementioned parts, the parting planes running parallel in relation to one another and, in the exemplary embodiment represented, standing vertically. Acting upon the first mold part 5 is a stationary fixing platen 11, extending out from which there are guide posts 12, 13, on which a movable fixing platen 14 is mounted so as to be longitudinally displaceable in a linear manner, the two molds 2 and 3 and the intermediate element 4 being arranged between the two fixing platens 11 and 14. By means of a drive device, not represented in greater detail, the molds 2 and 3 and the intermediate element 4 can be loaded against each other in the form of a stack by means of the fixing platens 11 and 14. This results in the mold parts 5 and 6 and the mold parts 7 and 8 being brought together, such that the molds 2 and 3 are in a closed state. At least one mold cavity is realized in each case between the mold elements 5 and 6 and the mold elements 7 and 8, such that—according to the number of mold cavities realized—a corresponding number of workpieces can be produced through infeed of a hot, solidifying medium in a filling channel 15. The filling channel 15 leads to a casting runner 16 (FIG. 2) extending between the two intermediate-element parts 9 and 10, such that the medium can flow, via corresponding casting channels, as far as into the mold cavities. After the workpieces, produced in this manner, have set, the molds 2 and 3 are opened as shown in FIG. 2. For this purpose, a unit 17, consisting of the mold part 6, the intermediate element 4 and the mold part 7, shifts along the guide posts 12 and 13 in such a way that the mold parts 5 and 6 become separated. Further, the fixing platen 14 shifts together with the mold part 8, in such a way that the mold 3 opens (FIG. 2).

Figure 3:
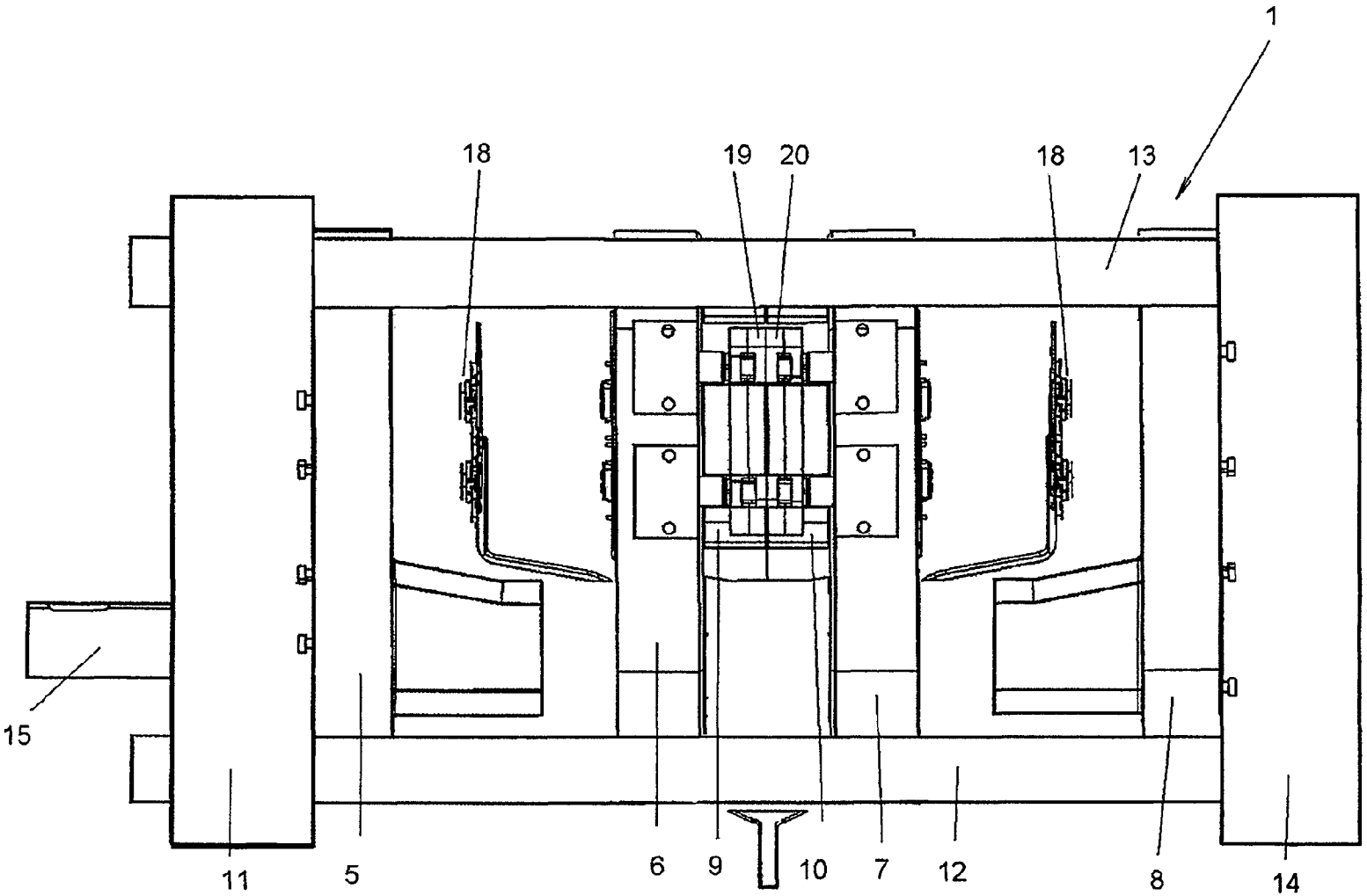
FIG. 3 shows the representation of FIG. 1 in an opened position.

FIG. 3 shows the fully separated state. The distances between the mold parts 5 and 6, on the one hand, and 7 and 8, on the other hand, are of such magnitude that the workpieces 18 produced can be demolded without difficulty.

It can be seen from FIGS. 1 to 3 that the two molds 2 and 3 are arranged in the form of a stack, the intermediate element 4 being interposed. Since the medium is fed into the two molds 2 and 3 by means of the intermediate element 4, the intermediate position of the intermediate element 4 enables these molds to be charged simultaneously, and by only the one casting runner 16. Further, the intermediate element 4 has ejector devices 19 and 20, the ejection device 19 being assigned to the intermediate-element part 9 and the ejection device 20 being assigned to the intermediate-element part 10. Further, arranged in the region of the intermediate element 4—according to FIG. 1—there is a shearing device 21 (not represented in FIGS. 2 and 3), which serves to shear off a sprue. This is the solidified medium in the casting runner 16. This is described more fully in the following.

Figure 4:
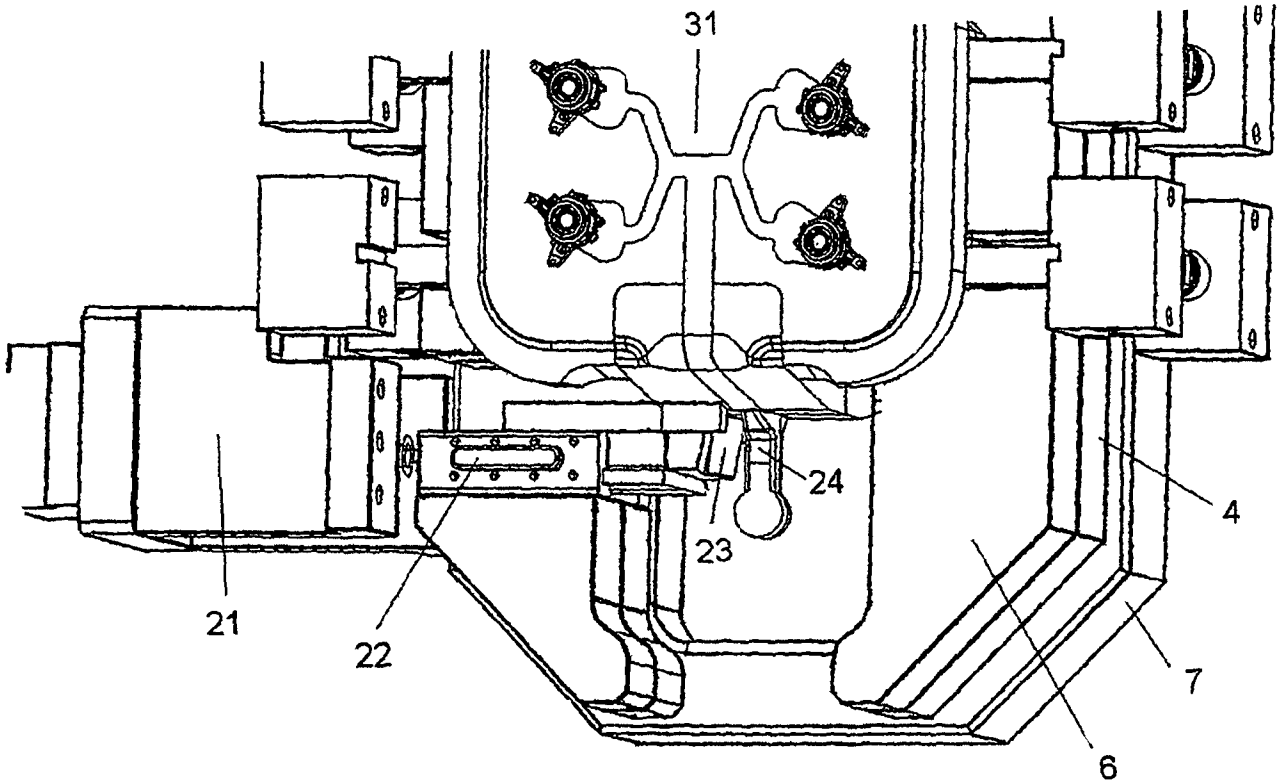
FIG. 4 shows a lower region of the die casting tool in the region of a shearing device, which is commencing an operation of shearing off a sprue.
Figure 5:
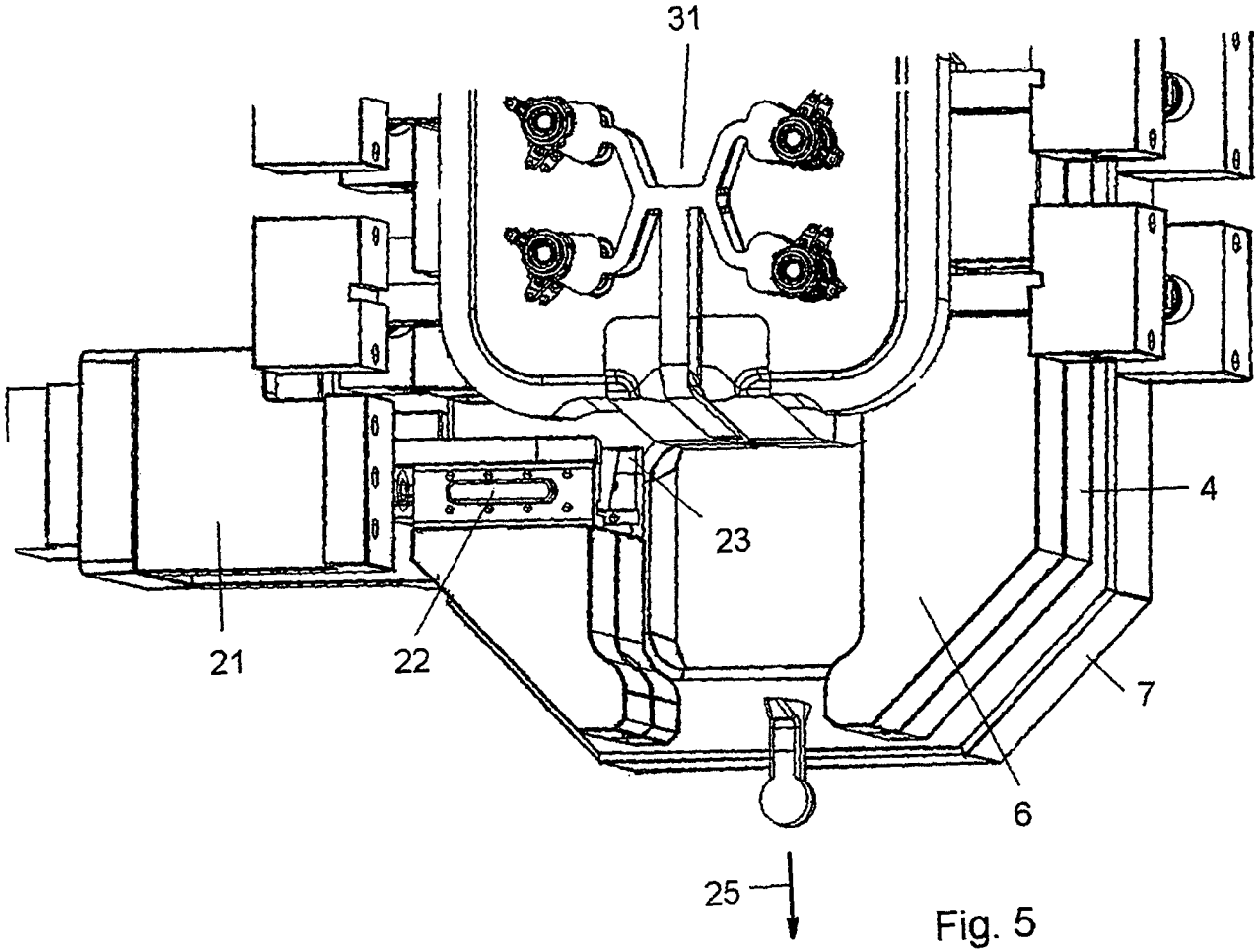
FIG. 5 shows the representation of FIG. 4 when the sprue has been sheared off.

FIGS. 4 and 5 show the shearing device 21, which has a slide 22 that is moved back and forth linearly, its direction of motion running parallel in relation to the parting planes—and therefore perpendicular in relation to the shift direction of the mold parts—between the mold parts 5 to 8 and intermediate-element parts 9 and 10. On the slide 22 there is a shearing blade 23. When the slide 22 is moved out of the shearing device 21, it comes into contact with a sprue 24. The latter is composed of a fully or partially solidified medium, and is freely accessible as a result of the intermediate-element parts 9 and 10 moving apart from each other. The effected motion of the shearing blade 23 results in the sprue 24 being parted off, such that—as shown in FIG. 5—it drops downwards (arrow 25). The shearing blade 23 can then be retracted (as shown in FIG. 5).

Figure 6:
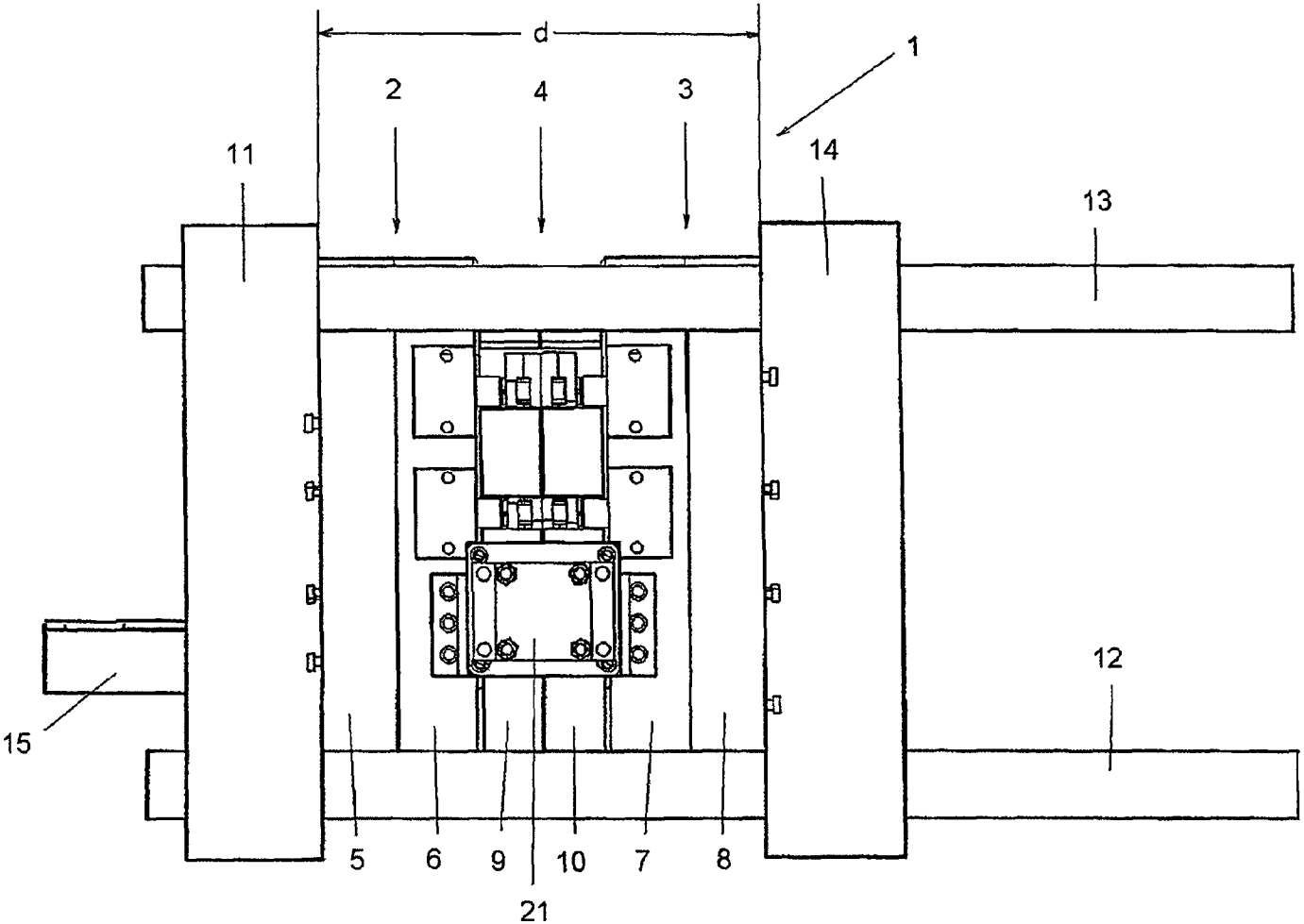
FIG. 6 shows the representation of FIG. 1 in enlarged scale.
Figure 7:
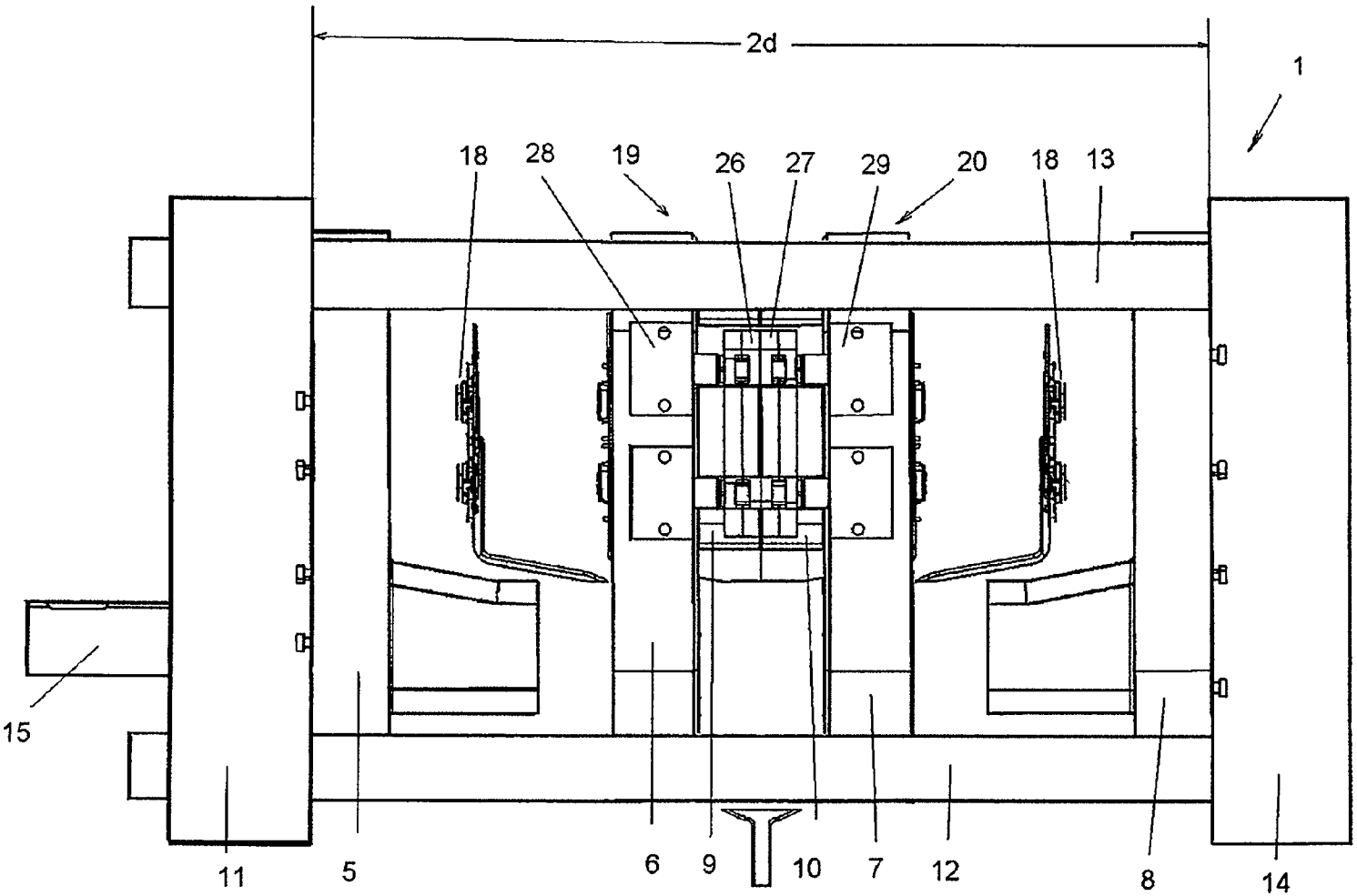
FIG. 7 shows the representation of FIG. 3 in enlarged scale.
Figure 8:
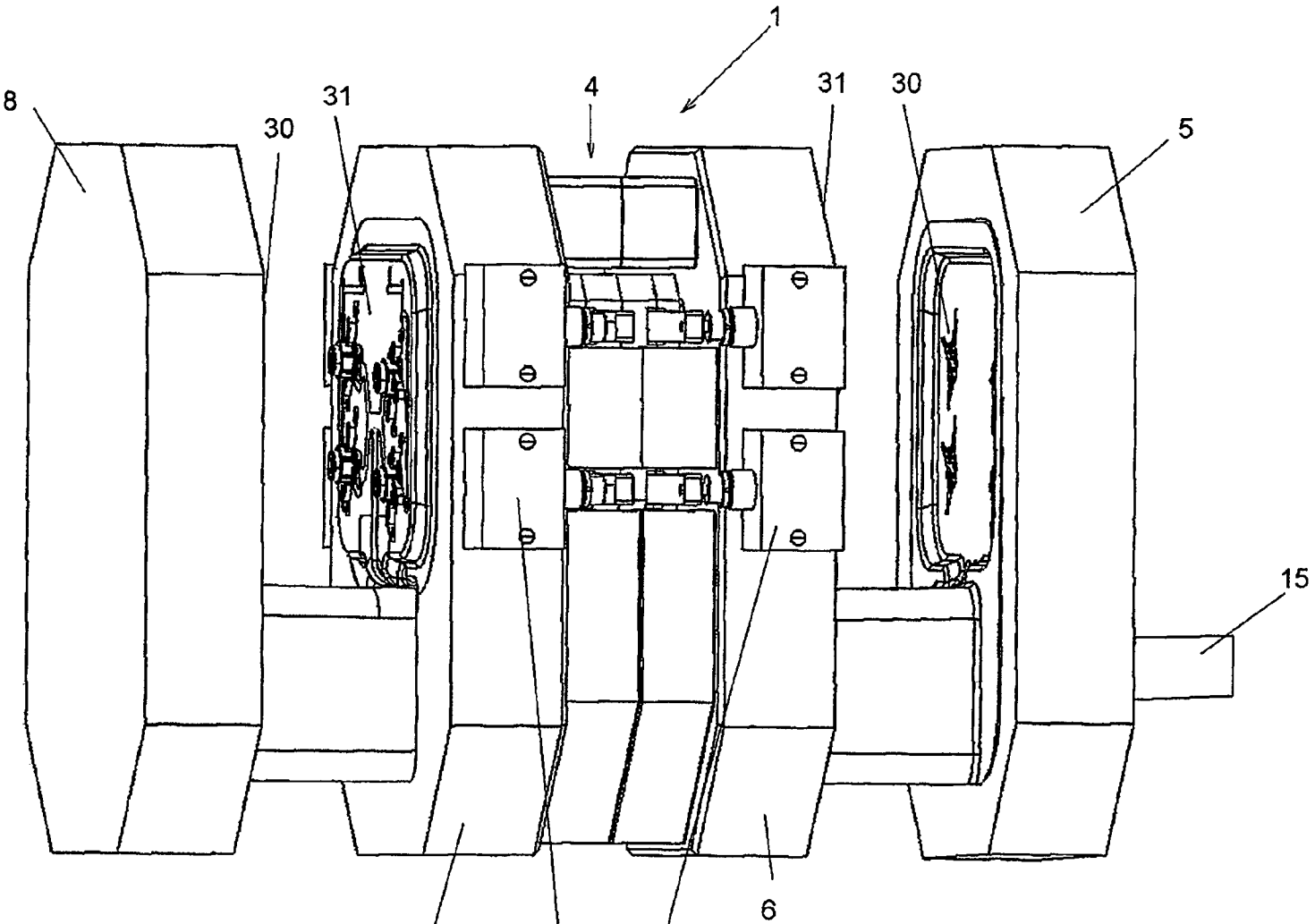
FIG. 8 shows a perspective representation of a region of the representation of FIG. 7.

FIGS. 6 to 8 elucidate the representations of FIGS. 1 to 3. After the sprue 24 has been sheared off, demolding of the workpieces 18 is effected. For this purpose, ejector plates 26 and 27, which pertain to ejector devices 19 and 20, are provided on the intermediate-element parts 9 and 10. The ejector devices 19 and 20 have ejector cylinders 28 and 29, which are arranged at the side or upwards in relation to the mold parts 6 and 7, and which are realized as block cylinders. They enable an ejection force to be applied in such a way that—as shown in FIG. 7—the workpieces 18 are ejected. FIG. 8 shows a perspective representation of the arrangement of FIG. 7, but rotated by 180° about a vertical axis, and in a perspective view. It can be seen that the mold parts 5 to 8 carry, respectively, mold inserts 30 and 31, which are exchangeable, to enable differing workpieces 18 to be produced.

A comparison of FIGS. 6 and 7 shows that, in the closed position, the stage packet, constituted by the first mold 2, the second mold 3 and the intermediate element 4, has the distance d. In the fully opened position according to FIG. 7, the distance is 2*d*, i.e. approximately twice as great. Hence, the die casting tool 1 according to the invention requires only a relatively small amount of space for its operation and, nevertheless, owing to the staged structural design, a multiplicity of workpieces 18 can be produced per unit of time.

When the die casting tool 1 has completed a production cycle according to FIGS. 1 to 3, the molds 2 and 3 are reclosed, and a die casting operation can commence over again.

The invention claimed is:

1. A die casting tool of a die casting machine, comprising a first mold having a first and a second mold part movable linearly relative to and separable from each other for the purpose of mold closing and mold opening and which define at least one mold cavity, and comprising a casting runner, a second mold having a third and a fourth mold part, movable linearly relative to each other and which act in a direction the same as the first and second mold parts of the first mold, for the purpose of mold closing and mold opening and which at least a second mold cavity, wherein one of the first and second mold parts of the first mold and one of the third and fourth mold parts of the second mold are arranged back-to-back in relation to each other and accommodate between each other an intermediate element that comprises the casting runner, the casting runner leads to both the first and the second mold cavities, a shearing device is assigned to the intermediate element for shearing off a sprue relating to both the first and second molds, and the intermediate element has at least two ejector devices for the first and second molds, wherein the intermediate element has two intermediate-element parts, which are arranged back-to-back in relation to the first mold and the second mold and separable from each other.

2. The die casting tool as claimed in claim 1, wherein the shearing device has a shearing blade that is movable linearly, wherein the movable direction of the shearing blade runs transversely with respect to the linear movement of the mold parts.

3. The die casting tool as claimed in claim 1, wherein the ejector devices have ejection cylinders which are arranged at a side of each of the first, second, third and fourth mold parts, which adjoin the intermediate element.

4. The die casting tool as claimed in claim 1, wherein the first mold part of the first mold is a fixed mold part, in relation to which, for the purpose of closing and opening the first mold, a unit, consisting of the second mold part of the first mold, the intermediate element and the third mold part of the second mold, is shifted linearly, and, for the purpose of closing and opening the second mold, the fourth mold part can be shifted linearly in relation to the unit.

5. The die casting tool as claimed in claim 1, wherein the first mold part has a fixed, exchangeable mold insert, and the second, the third and the fourth mold part have travelling, exchangeable mold inserts.

6. The die casting tool as claimed in claim 1, wherein a stationary fixing platen and a movable fixing platen are shiftable linearly in relation thereto via guide posts, wherein at least the first and second molds and the one intermediate element are arranged between the two fixing platens.

* * * * *